US010891904B2

(12) United States Patent
Jeon et al.

(10) Patent No.: US 10,891,904 B2
(45) Date of Patent: Jan. 12, 2021

(54) ORGANIC LIGHT-EMITTING DIODE-BASED DISPLAY DEVICE AND METHOD FOR DRIVING THE DEVICE

(71) Applicant: LG Display Co., Ltd., Seoul (KR)

(72) Inventors: Wonsik Jeon, Daegu (KR); Jongsik Ham, Gwangmyeong-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/503,088

(22) Filed: Jul. 3, 2019

(65) Prior Publication Data

US 2020/0013344 A1 Jan. 9, 2020

(30) Foreign Application Priority Data

Jul. 6, 2018 (KR) ..... 10-2018-0079027

(51) Int. Cl.
*G09G 3/3275* (2016.01)
*G09G 3/20* (2006.01)

(52) U.S. Cl.
CPC ..... *G09G 3/3275* (2013.01); *G09G 3/2011* (2013.01); *G09G 3/2074* (2013.01); *G09G 2310/027* (2013.01); *G09G 2310/0286* (2013.01); *G09G 2310/0291* (2013.01); *G09G 2320/041* (2013.01); *G09G 2320/0673* (2013.01); *G09G 2330/021* (2013.01)

(58) Field of Classification Search
CPC .. G09G 3/3233; G09G 3/3208; G09G 3/3225; G09G 2310/027; G09G 2320/0673; G09G 2310/0291
See application file for complete search history.

(56) References Cited

U.S. PATENT DOCUMENTS

2013/0249969 A1* 9/2013 Jeon ..... G09G 3/3696 345/691
2014/0160178 A1* 6/2014 Hong ..... G09G 3/2007 345/690
2016/0117991 A1* 4/2016 Ha ..... G09G 3/3233 345/78
2016/0322001 A1* 11/2016 Do ..... G09G 3/3291

FOREIGN PATENT DOCUMENTS

KR 10-2012-0124368 A 11/2012
KR 10-2013-0005966 A 1/2013

* cited by examiner

*Primary Examiner* — Koosha Sharifi-Tafreshi
(74) *Attorney, Agent, or Firm* — Fenwick & West LLP

(57) ABSTRACT

Disclosed are an organic light-emitting diode-based display device and a method for controlling the device. The device may include an organic light-emitting diode-based display panel; and a data driver configured for: dividing a reference gamma voltage into a first gamma voltage corresponding to a high gray level and a second gamma voltage corresponding to a low gray level; selecting one between the first and second gamma voltage based on a gray level of video data; and supplying the selected one through a corresponding output stage among dual output stages, wherein the dual output stages respectively correspond to the first and second gamma voltages.

16 Claims, 12 Drawing Sheets

[FIG 1]
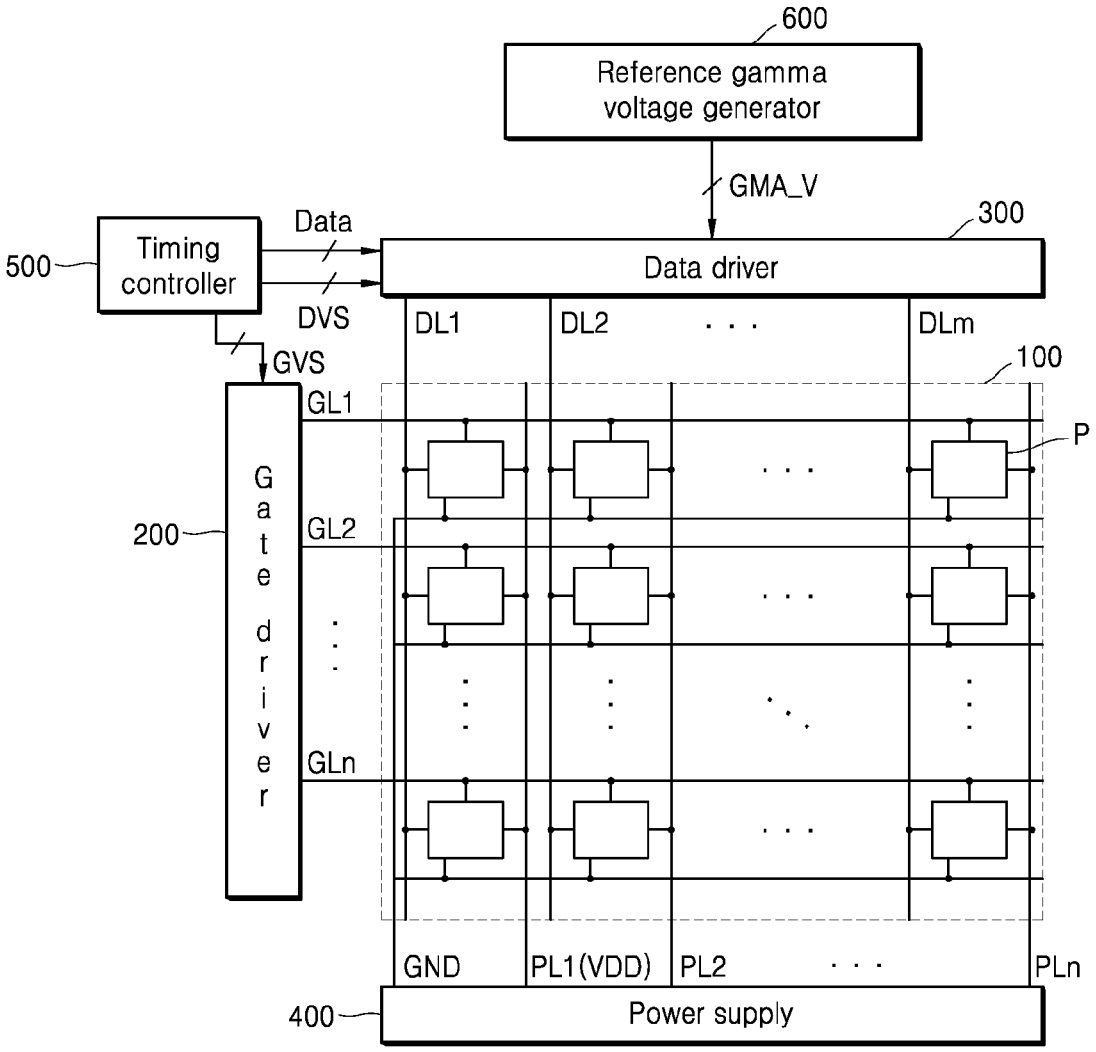

[FIG 2]
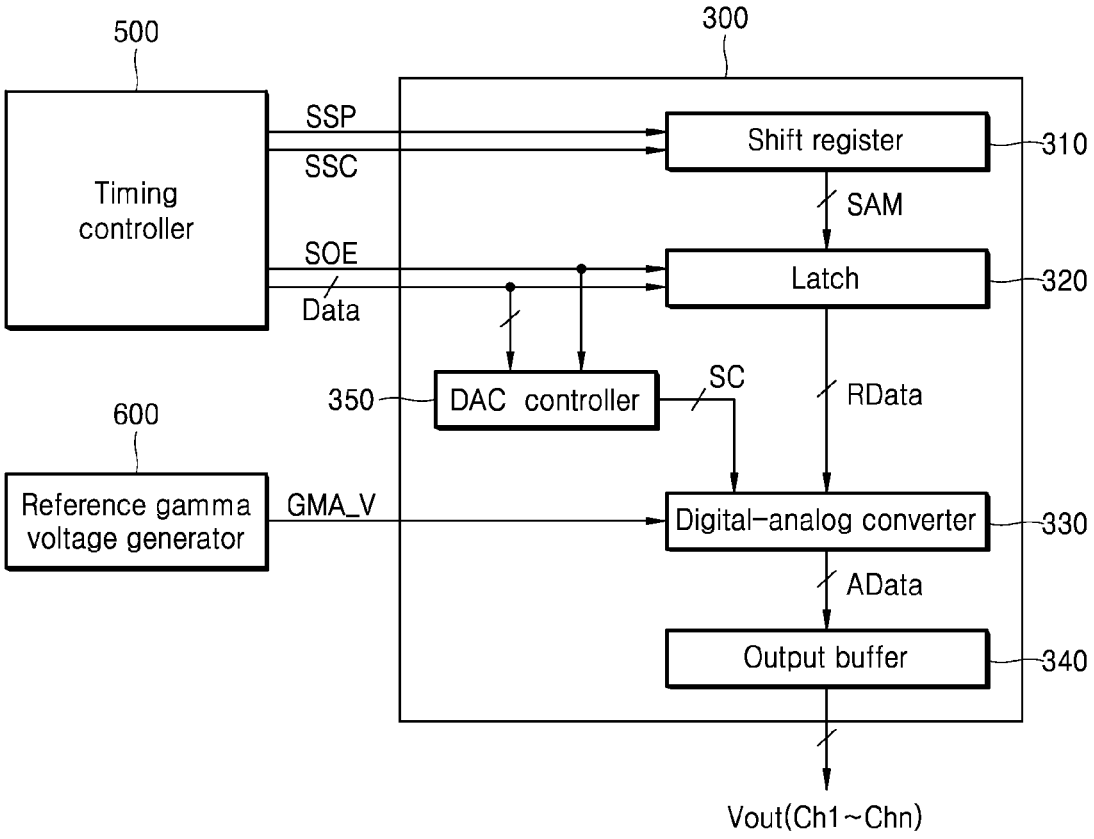

[FIG 3]
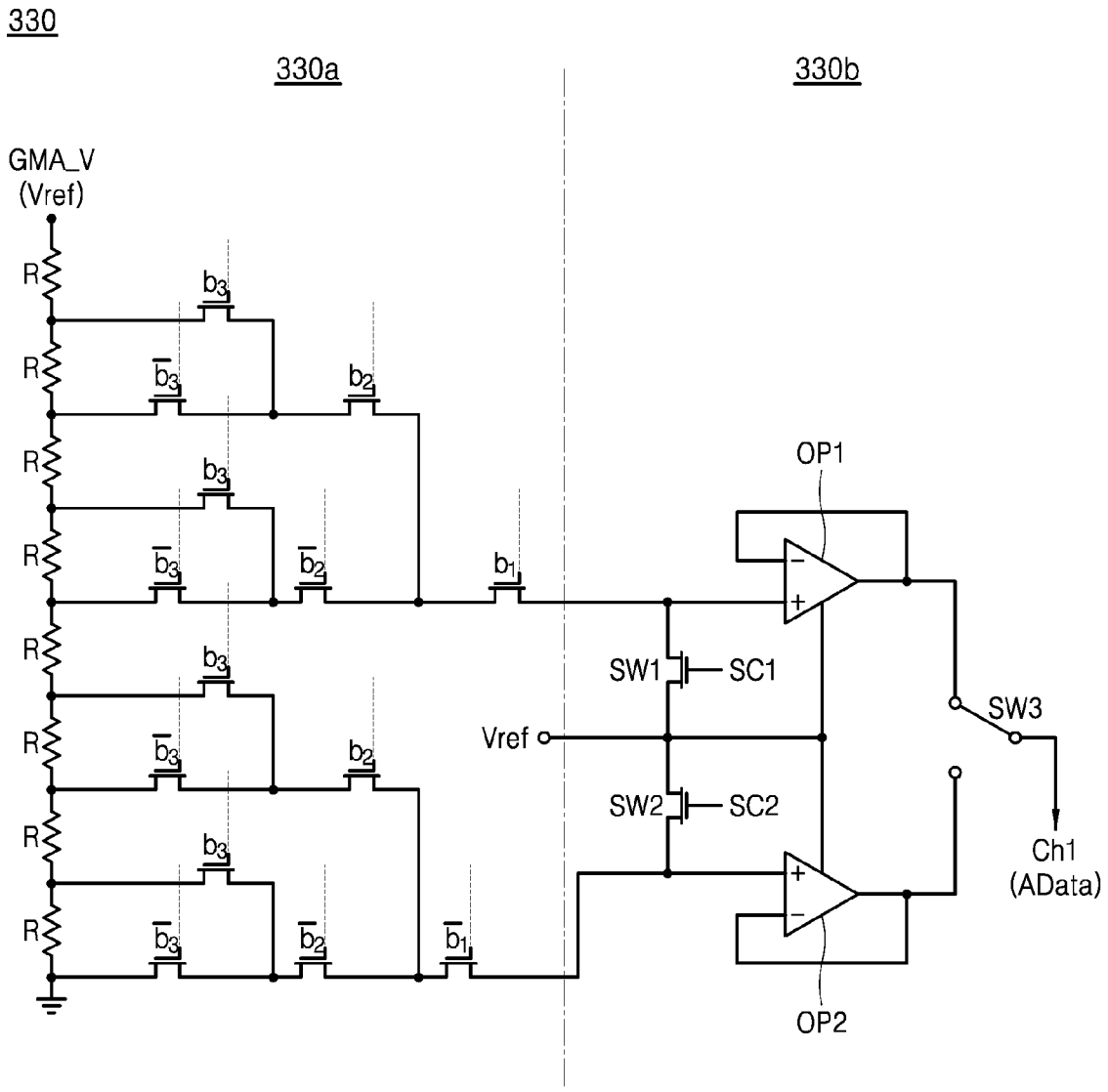

[FIG 4]
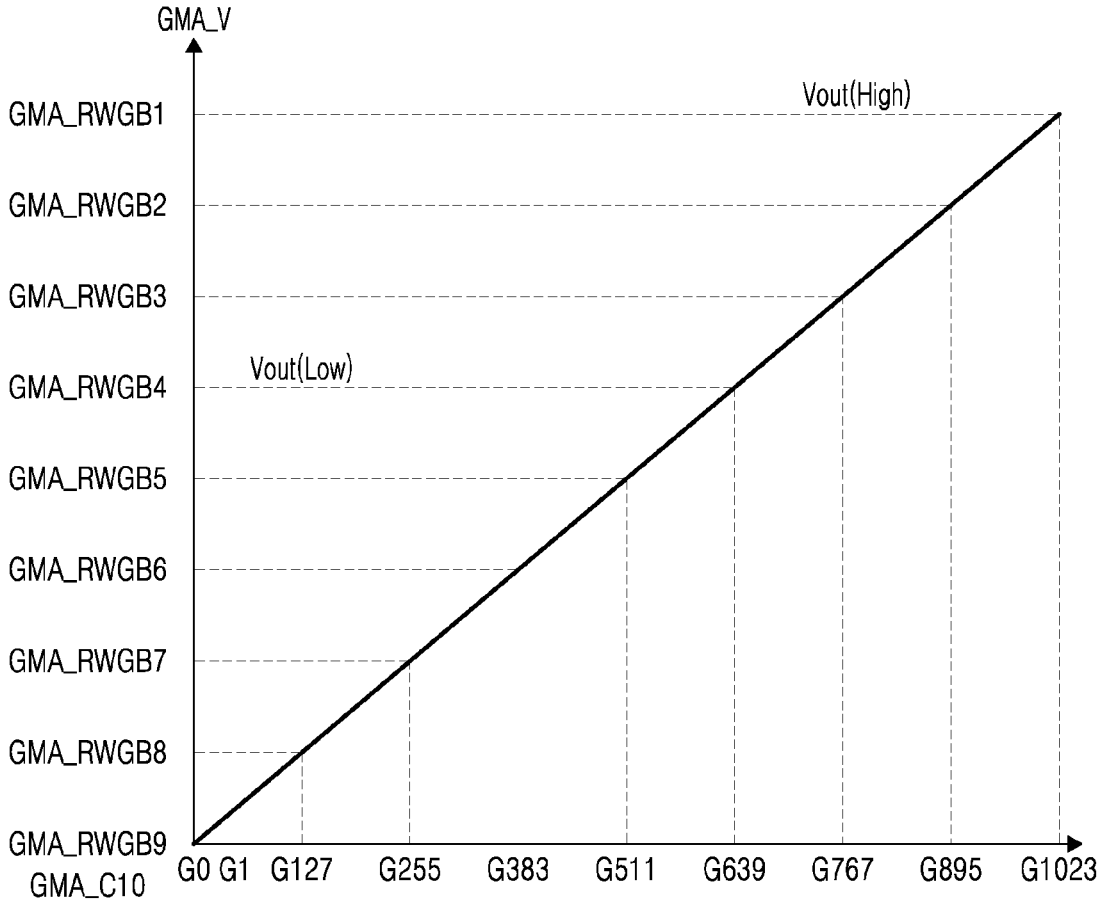

[FIG 5]
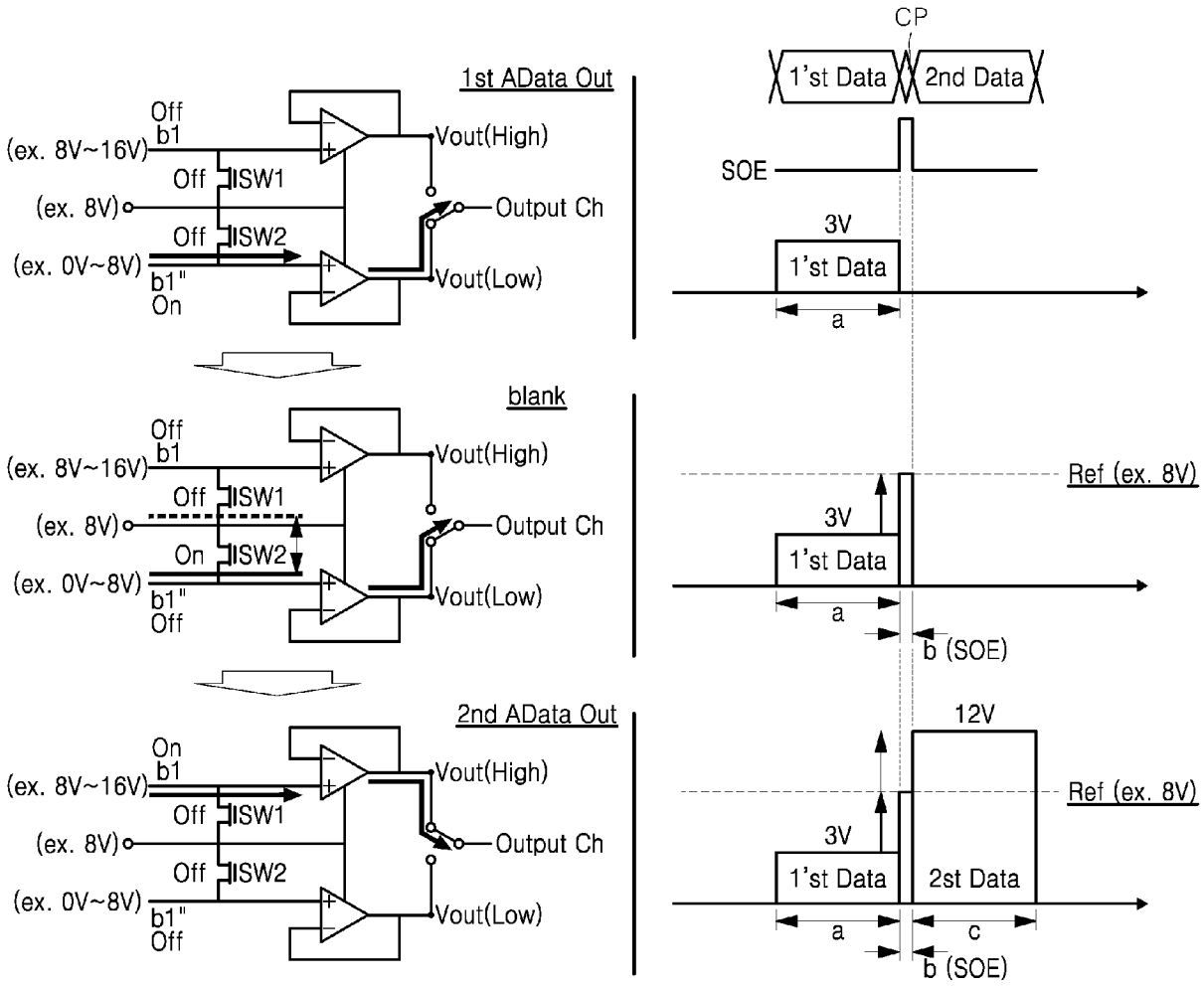

[FIG 6]
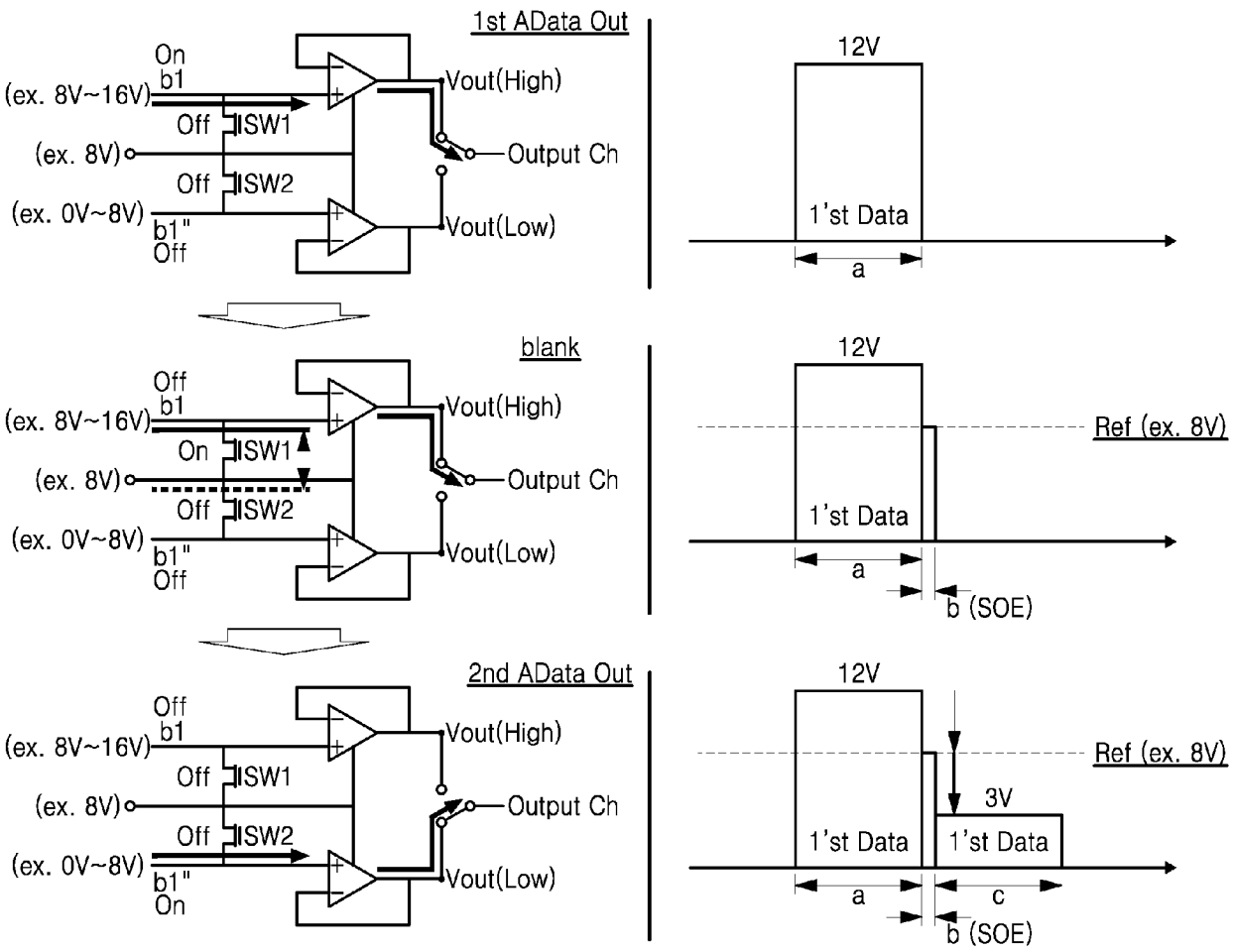

[FIG 7]
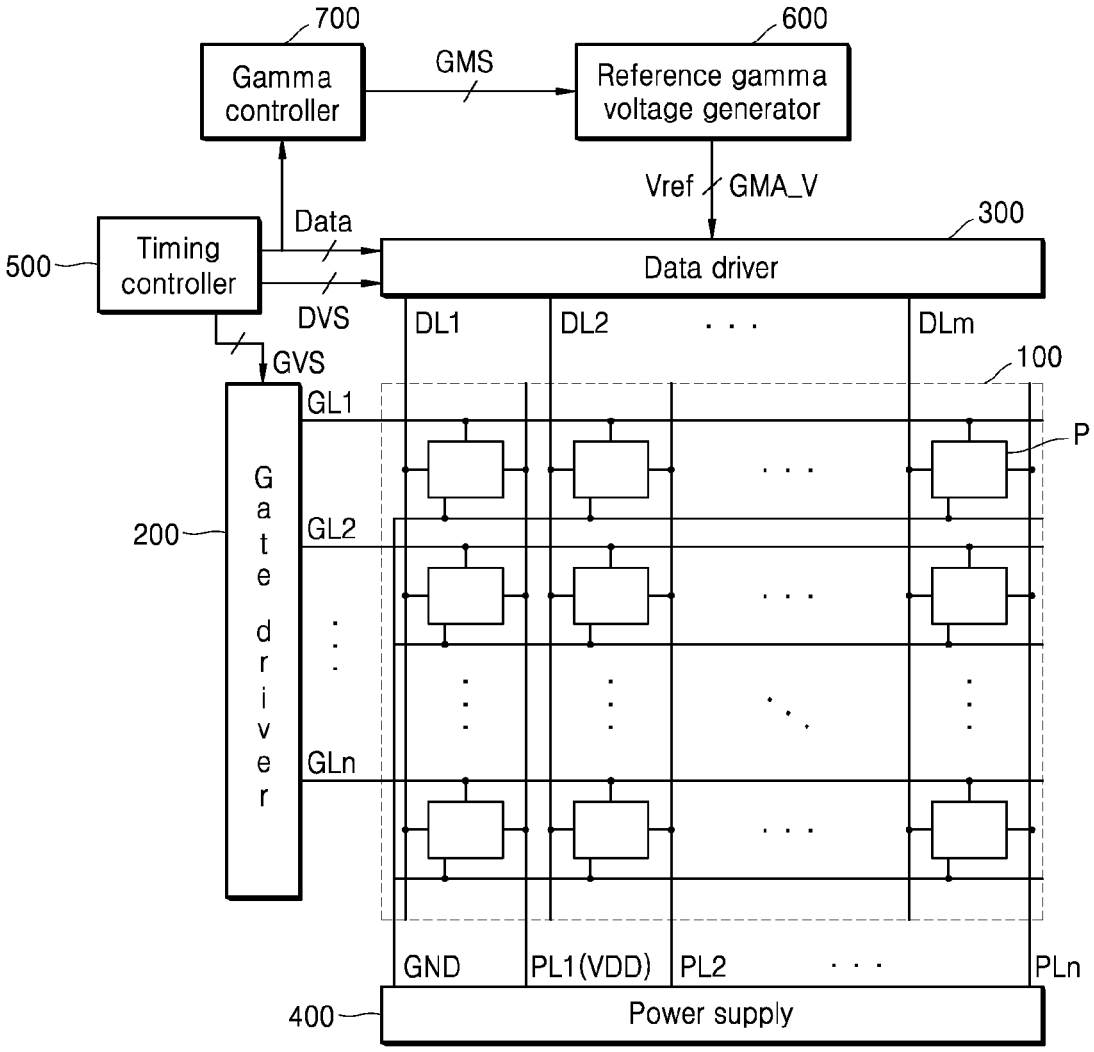

[FIG 8]
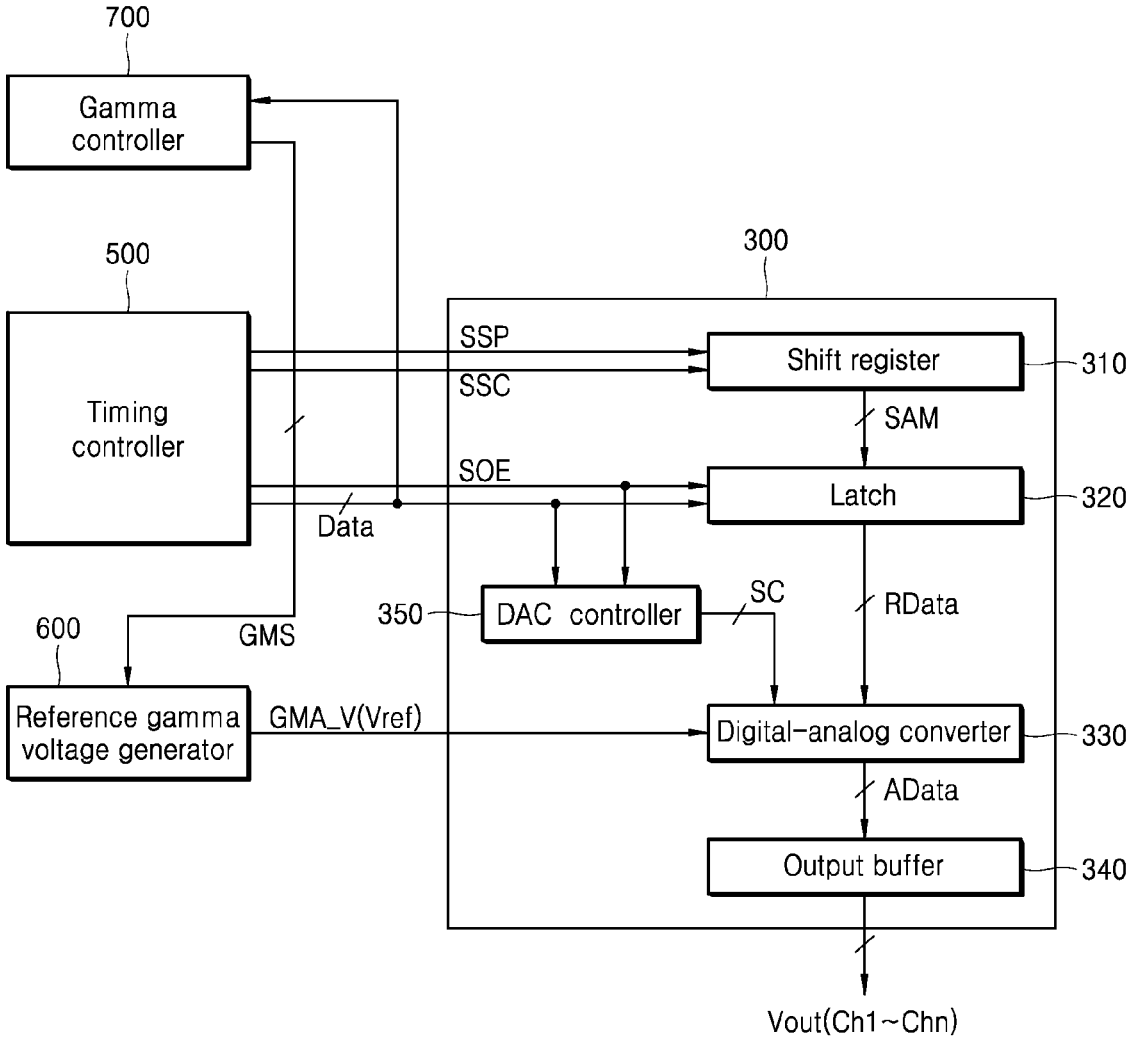

[FIG 9]
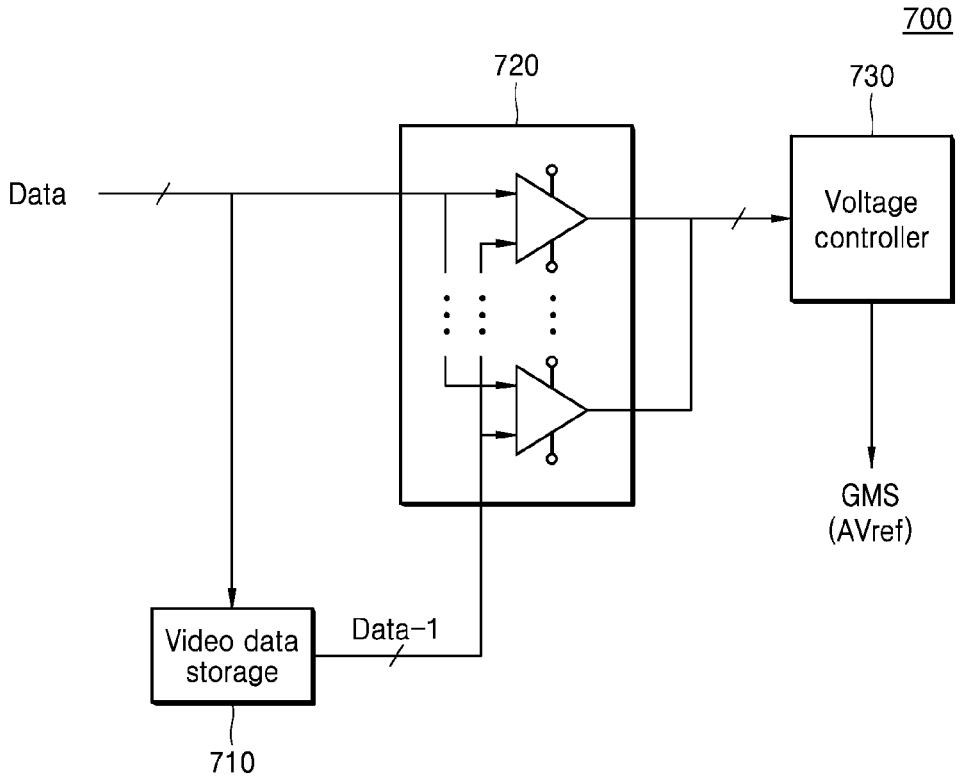

[FIG 10]
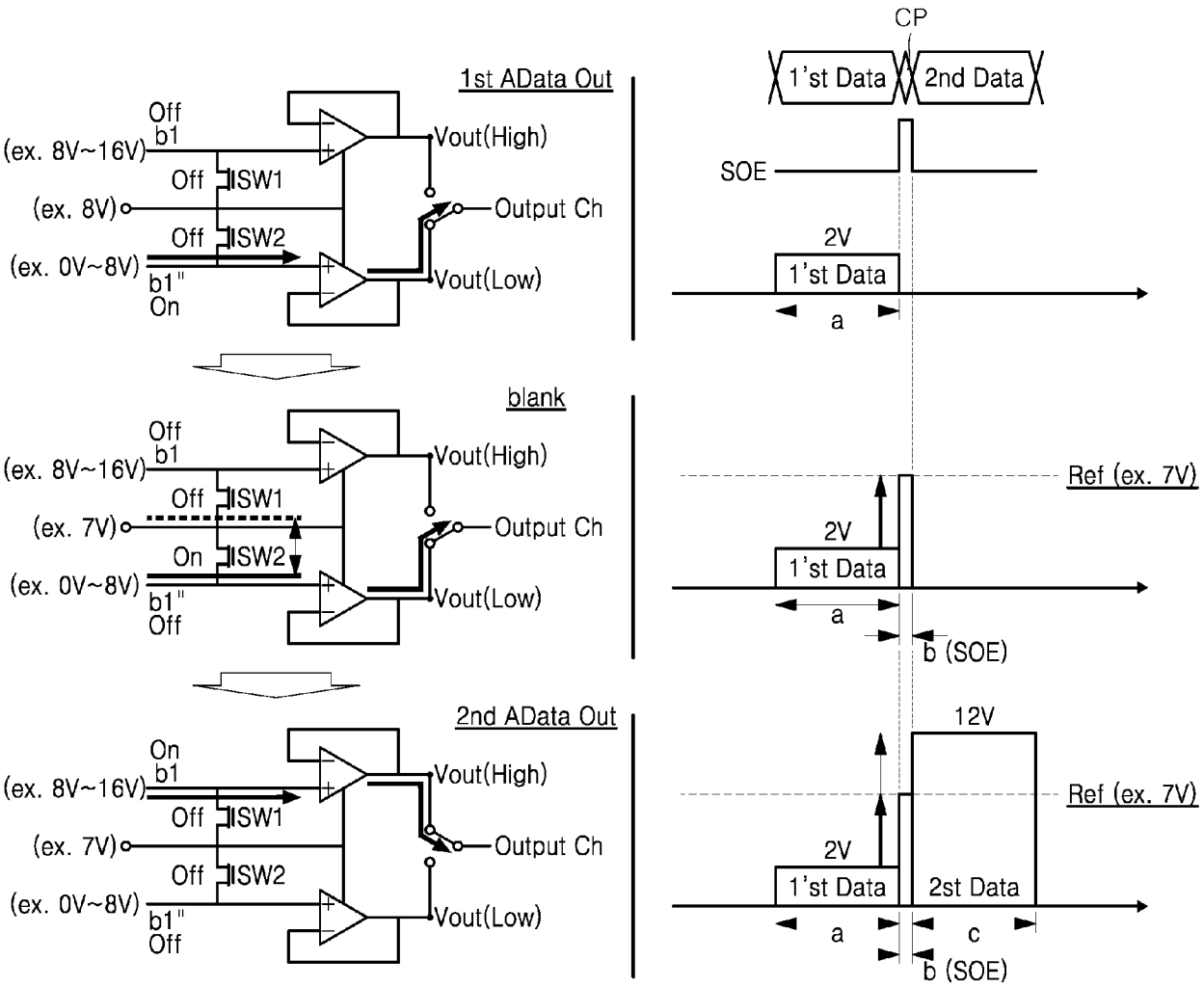

[FIG 11]
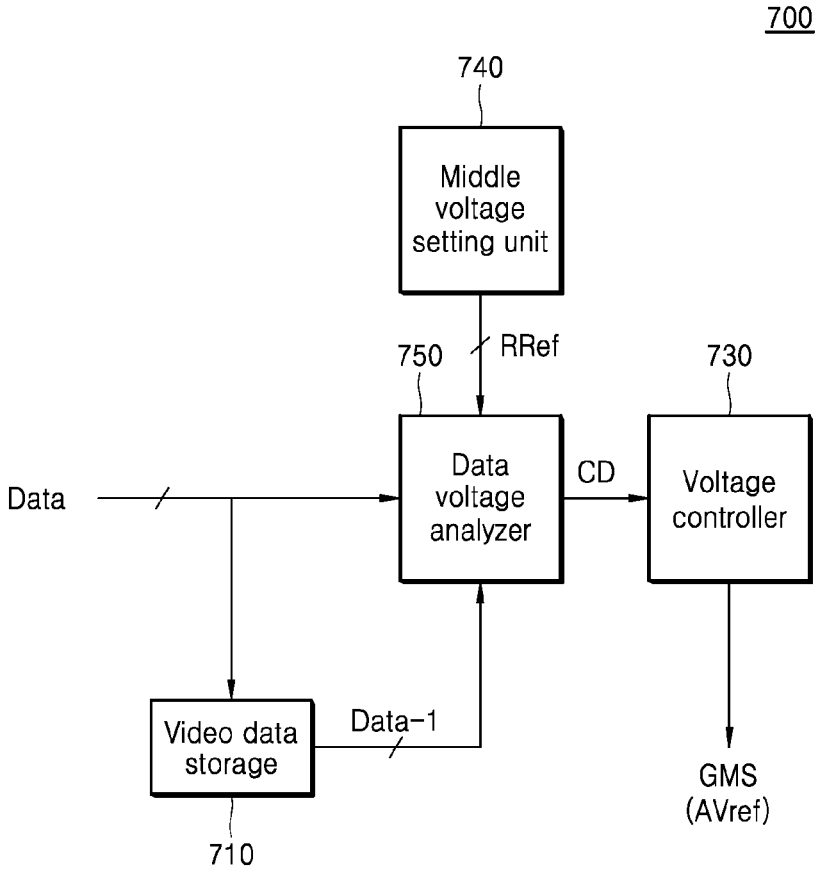

[FIG 12]
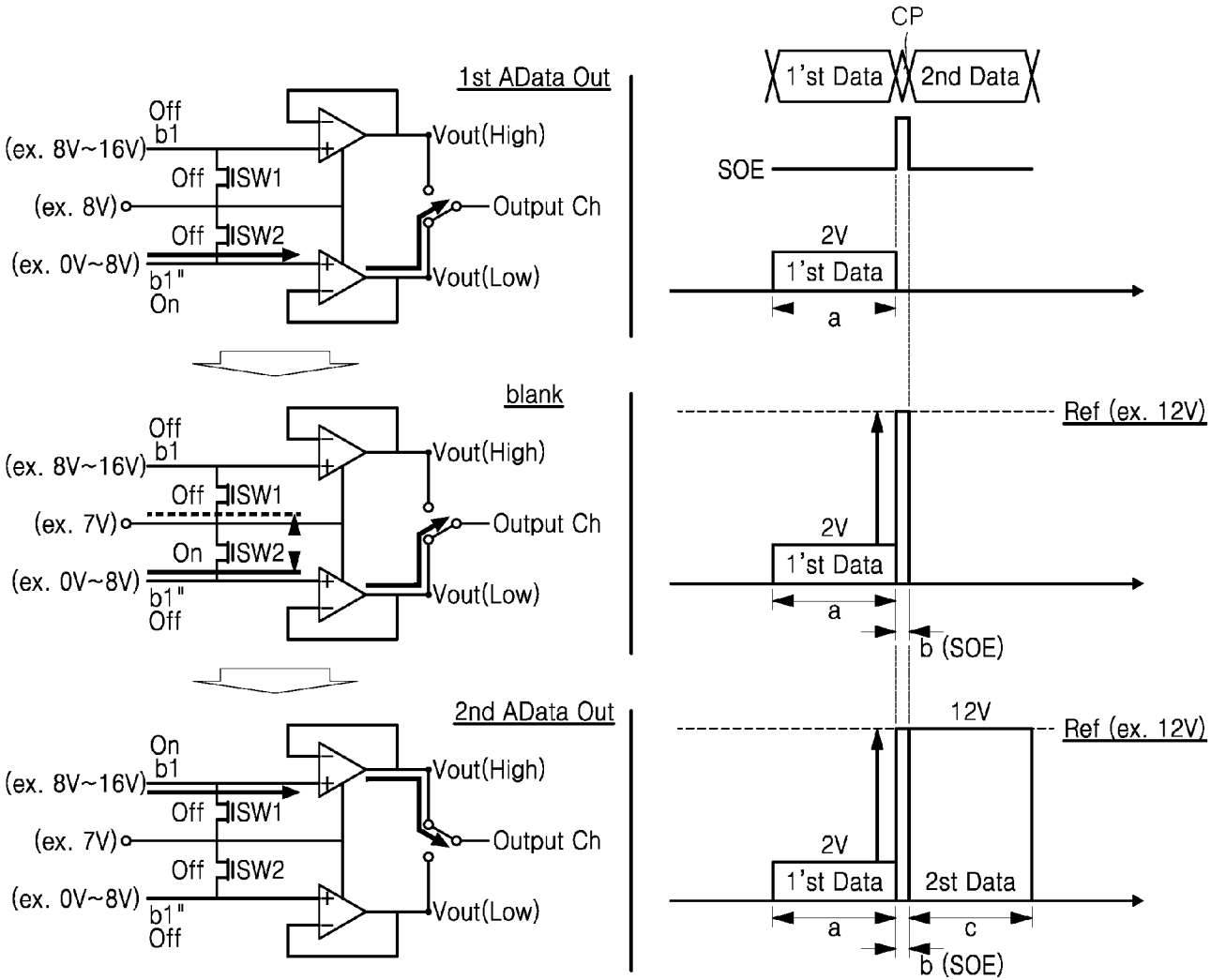

ORGANIC LIGHT-EMITTING DIODE-BASED DISPLAY DEVICE AND METHOD FOR DRIVING THE DEVICE

CROSS-REFERENCE TO RELATED APPLICATIONS

This application claims the priority of Republic of Korea Patent Application No. 10-2018-0079027 filed on Jul. 6, 2018 in the Korean Intellectual Property Office, the disclosure of which is hereby incorporated by reference in its entirety.

BACKGROUND

1. Technical Field

The present disclosure relates to an organic light-emitting diode-based display device, and, more particularly, to an organic light-emitting diode (OLED) display device and a method for driving the device, in which a displayed image quality is improved while power consumption is reduced via driving stabilization of a data driver.

2. Description of the Related Art

Flat type display devices are used in various kinds of electronic products including mobile phones, tablet PCs, and notebooks. The flat type display device may include a liquid crystal display device, an organic light-emitting diode-based display device, and an electronic wetting display device.

A liquid crystal display device, an organic light-emitting diode-based display device, or the like displays an image by controlling light transmittance or light emission amount of each pixel in an image display panel in which a plurality of pixels are arranged in a matrix form. To this end, panel driver circuits for driving the pixels of the image display panel are mounted on the image display panel or are electrically connected thereto.

In one example, in the organic light-emitting diode-based display panel, a plurality of gate lines and data lines are arranged to cross each other. In each pixel region defined by intersection of the gate lines and data lines, an OLED (Organic Light Emitting Diode) element and a pixel circuit for independently driving each OLED element are disposed. The panel driver circuit includes a gate driver that sequentially drives the gate lines, a data driver that supplies data voltages to the data lines, and a timing controller that controls driving timing of the gate and data driver.

The data driver supplies data voltages to the respective data lines on a horizontal line basis according to timings of sequentially driving the gate lines, thereby displaying the images on the respective pixels. To this end, the data driver subdivides a reference gamma voltage into gray level-based gamma voltage levels. The data driver uses the subdivided gray level-based gamma voltages to convert digital data to analog data voltage. Then, the analog data voltages are supplied to the pixel circuits of each pixel so that the images are displayed on the respective pixels.

A conventional data driver includes a string of a plurality of resistors and switching elements for selectively connecting respective nodes of the resistors. The gray level-based gamma voltage is set according to a distribution voltage level of the resistor string and is used as the data voltage.

However, conventionally, a data voltage of each pixel is generated and output by using a single resistor string and switch elements for an entirety of a range from a gamma voltage corresponding to a low gray level to a gamma voltage corresponding a high gray level. Thus, as the data voltage level changes to the low gray level or high gray level increases, the consumption current increases and the amount of heat generated increases. In particular, as the current consumption increases and the heat amount increases, a load and risk applied to the data driver increases. For this reason, a level of the reference gamma voltage must be raised up.

SUMMARY

The present disclosure aims at solving the above-mentioned problems. Thus, a purpose of the present disclosure is to provide an organic light-emitting diode (OLED) display device and a method for driving the device, by which an image quality of a displayed image is improved while the device is driven more stably. This may be achieved in that a data driver divides a gray level-based gamma voltage for generating the data voltage into a gamma voltage level corresponding to a high gray level and a gamma voltage level corresponding to a low gray level, and applies the gamma voltage level corresponding to the high gray level and the gamma voltage level corresponding to the low gray level through different amplification units or output stages respectively to each of data lines.

The purposes of the present disclosure are not limited to the above-mentioned purposes. Other purposes and advantages of the present disclosure, as not mentioned above, may be understood from the following descriptions and more clearly understood from the embodiments of the present disclosure. Further, it will be readily appreciated that the purposes and advantages of the present disclosure may be realized by features and combinations thereof as disclosed in the claims.

In one aspect of the present disclosure, there is proposed an organic light-emitting diode-based display device comprising: an organic light-emitting diode-based display panel having a plurality of pixel regions defined by a plurality of gates and data lines; a data driver configured for: dividing a reference gamma voltage into a gamma voltage corresponding to a high gray level and a gamma voltage corresponding to a low gray level; selecting one between the gamma voltage corresponding to the high gray level and the gamma voltage corresponding to the low gray level based on a gray level of video data; and supplying the selected one, as data voltage, through a corresponding output stage among dual output stages to a corresponding data line of the display panel, wherein the dual output stages respectively correspond to the gamma voltage corresponding to the high gray level and the gamma voltage corresponding to the low gray level; and a digital-analog converter (DAC) controller configured for control the data driver such that the selected one is supplied through the corresponding output stage among the dual output stages to a corresponding data line.

In another aspect of the present disclosure, there is proposed a method for driving an organic light-emitting diode-based display device, the method comprising: sequentially supplying a gate-on signal to gate lines of an organic light-emitting diode-based display panel having a plurality of pixel regions defined therein; dividing a reference gamma voltage into a gamma voltage corresponding to a high gray level and a gamma voltage corresponding to a low gray level; selecting one between the gamma voltage corresponding to the high gray level and the gamma voltage corresponding to the low gray level based on a gray level of video data; supplying the selected one, as data voltage, through a corresponding output stage among dual output stages to a corresponding data line of the display panel, wherein the dual output stages respectively correspond to the gamma voltage corresponding to the high gray level and the gamma voltage corresponding to the low gray level; and controlling a digital-analog converter such that the selected one is supplied through the corresponding output stage among the dual output stages to the corresponding data line.

In the organic light-emitting diode-based display device and the method for driving the device according to the embodiments of the present disclosure having various technical features as described above, the data driver divides the gray level-based gamma voltage for generating the data voltage into a high gray level range and a low gray level range. The high gray level and low gray level-based gamma voltages are output through the dual amplifiers or output stages, respectively, to each of the data lines. Accordingly, this may stabilize the driving of the data driver by reducing the amount of heat as generated while preventing an increase in power consumption.

Further, in the organic light-emitting diode-based display device and the method for driving the device according to the embodiments of the present disclosure having various technical features as described above, the data driver outputs the data voltage according to the gray level of the video data, and then outputs the gamma voltage corresponding to the middle gray level to the data line for a blank period as a period before outputting the data voltage according to the gray level in the subsequent horizontal line period. Therefore, this may improve the displayed image quality by increasing the varying speed of the data voltage according to the brightness change of the displayed image.

Furthermore, in the organic light-emitting diode-based display device and the method for driving the device according to the embodiments of the present disclosure having various technical features as described above, the data driver analyzes the data voltage magnitude of the currently displayed video data and the data voltage magnitude of the subsequently displayed video data. Then, the gamma voltage to be outputted to each of the data lines for the blank period may be varied according to the analysis result. Accordingly, this may further increase the varying speed of the data voltage in correspondence with the brightness change of the displayed image, and thus further improve the image quality of the displayed image.

In addition to the above effects, specific effects of the present disclosure are described below in conjunction with descriptions of specific details to implement the present disclosure.

BRIEF DESCRIPTION OF THE DRAWINGS

FIG. 1 is a configuration diagram illustrating an organic light-emitting diode-based display device including a data driver according to a first embodiment of the present disclosure.

FIG. 2 is a configuration diagram illustrating a structure of a timing controller, a reference gamma voltage generator, and a data driver shown in FIG. 1 in more detail according to an embodiment of the present disclosure.

FIG. 3 is a configuration diagram specifically illustrating a dual type digital-analog converter (DAC) shown in FIG. 2 according to an embodiment of the present disclosure.

FIG. 4 is a graph showing characteristics of low gray level-based and high gray level-based data voltages generated and output by the dual type DAC of FIG. 3 according to an embodiment of the present disclosure.

FIG. 5 shows configuration and waveform diagrams for sequentially illustrating a method of driving a dual type amplification module shown in FIG. 3 in accordance with one implementation.

FIG. 6 shows configuration and waveform diagrams for sequentially illustrating a method of driving a dual type amplification module shown in FIG. 3 in accordance with another implementation.

FIG. 7 is a block diagram specifically illustrating an organic light-emitting diode-based display device equipped with a data driver according to a second embodiment of the present disclosure.

FIG. 8 is a configuration diagram specifically illustrating a signal transmission structure of a timing controller, a gamma controller, a reference gamma voltage generator, and a data driver shown in FIG. 7 according to an embodiment of the present disclosure.

FIG. 9 is a configuration diagram specifically illustrating the gamma controller shown in FIG. 8 according to an embodiment of the present disclosure.

FIG. 10 is configuration and waveform diagrams for sequentially illustrating a method of driving a dual type amplification module according to a second embodiment of the present disclosure.

FIG. 11 is a block diagram specifically illustrating a gamma controller of an organic light-emitting diode (OLED) display device according to a third embodiment of the present disclosure.

FIG. 12 is configuration and waveform diagrams for sequentially illustrating a method of driving a dual type amplification module according to a third embodiment of the present disclosure.

DETAILED DESCRIPTIONS

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" a second element or layer, the first element may be disposed directly on the second element or may be disposed indirectly on the second element with a third element or layer being disposed between the first and second elements or layers. It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a configuration diagram illustrating an organic light-emitting diode-based display device including a data driver according to a first embodiment of the present disclosure.

The organic light-emitting diode-based display device shown in FIG. 1 includes an organic light-emitting diode-based display panel 100, a gate driver 200, a data driver 300, a power supply 400, a reference gamma voltage generator 600, and a timing controller 500.

A plurality of pixel regions are defined in the organic light-emitting diode-based display panel 100. A plurality of subpixels P are arranged in a matrix form in each pixel region to display an image. In this connection, the sub-pixel P in each pixel region includes an organic light-emitting diode and a diode driver circuit that independently drives the light-emitting diode. The diode driver circuits respectively supply analog data voltages from the respective data lines DLs to the light-emitting diodes while the diode driver circuits allow the data voltages to be charged in sub-pixels to maintain the light-emission state.

The gate driver 200 sequentially drives gate lines GL1 to GLn of the organic light-emitting diode-based display panel 100 every frame period. Specifically, the gate driver 200 receives a gate control signal GVS, for example, a gate start pulse GSP and a gate shift clock GSC from the timing controller 500, and sequentially generates gate on signals. The gate driver 200 controls a pulse width of the gate on signal according to a gate output enable GOE signal. The gate driver 200 sequentially supplies the gate on signals to the gate lines GL1 to GLn respectively.

The data driver 300 respectively supplies data voltages to the data lines DL1 to DLm of the organic light emitting diode-based display panel 100 every horizontal line driving period.

Specifically, the data driver 300 converts digital video data from the timing controller 500 into an analog data voltage using a source start pulse SSP and a source shift clock SSC in a data control signal DVS from the timing controller 500. The data driver 300 supplies a data voltage to each of the data lines DL1 to DLm in response to a source output enable SOE signal. Specifically, the data driver 300 latches the input video data Data according to the SSC. In response to the SOE signal, the data driver 300 supplies a video data voltage to each of the data lines DL1 to DLm by one horizontal line per one horizontal line period in which a scan pulse is supplied to each of the gate lines GL1 to GLn.

In order to convert the digital video data Data into an analog data voltage, the data driver 300 subdivides a reference gamma voltage GMA_V having multiple levels input from the reference gamma voltage generator 600 into gray level-based gamma voltages. In this connection, the subdivided gray level-based gamma voltage is selected and output as a gray level-based analog data voltage based on a gray level of the digital video data.

According to the present disclosure, the data driver 300 uses a dual structure DAC (digital to analog converter) to output the gray level-based gamma voltage such that the gray level-based gamma voltage is divided into a gamma voltage corresponding to a high gray level range, and the gamma voltage corresponding to the low gray level range. Then, the gamma voltage corresponding to the high gray level and the gamma voltage corresponding to the low gray level are respectively output through different amplifiers or output stages to a data line connection channel. As a result, the gamma voltage corresponding to the high gray level and the gamma voltage corresponding to the low gray level may be respectively amplified by different amplifiers and then supplied, as data voltages, to the respective data lines. A structure and driving method of the data driver 300 in accordance with the present disclosure will be described in more detail with reference to the accompanying drawings.

The power supply 400 supplies a first power signal VDD to power lines PL1 to PLn of the organic light-emitting diode-based display panel 100 and supplies a second power signal GND to a ground line.

The reference gamma voltage generator 600 generates a reference gamma voltage GMA_V having a plurality of levels on at least one set basis and transmits the generated voltage to the data driver 300.

Specifically, the reference gamma voltage generator 600 generates the reference gamma voltage GMA_V having a plurality of voltage levels in a voltage range from a gamma voltage corresponding to a lowest gray level (for example, 0 gray level) to a gamma voltage corresponding to a highest gray level (for example, 255 gray level). Then, the generated reference gamma voltage GMA_V is transmitted to the data driver 300. The reference gamma voltage GMA_V refers to a source voltage which may be subdivided into gray level-based gamma voltages using a string of multiple resistors and switching elements in the data driver 300. Such a reference gamma voltage GMA_V may fix a voltage in a stepwise manner so that the gray level-based gamma voltage levels as subdivided using the string of multiple resistors and switching elements are fixed.

The timing controller 500 configures external video data input thereto in accordance with the driving of the organic light-emitting diode-based display panel 100 and transmits the configured video data to the data driver 300. At the same time, the timing controller 500 generates data and gate control signals DVS and GVS to control the driving timings of the data and gate drivers 300 and 200.

Specifically, the timing controller 500 configures the external digital video data input thereto in accordance with the resolution of the organic light-emitting diode-based display panel 100, and supplies the configured video data to the data driver 300. Further, the timing controller 500 generates the data and gate control signals DVS and GVS using external synchronizing signals (not shown) input thereto and supplies the data and gate control signals DVS and GVS to the data driver 300 and the gate driver 200, respectively.

FIG. 2 is a configuration diagram illustrating a structure of the timing controller, the reference gamma voltage generator, and the data driver shown in FIG. 1 in more detail according to an embodiment of the present disclosure.

As shown in FIG. 2, the data driver 300 includes a shift register 310, a latch 320, a digital-analog converter (DAC) 330, a DAC controller 350, and an output buffer 340.

The shift register 310 generates a sampling signal SAM in response to a source start pulse SSP and a source shift clock SSC in a data control signal DVS from the timing controller 500. Specifically, the shift register 310 sequentially shifts the source start pulse SSP according to a source shift clock SSC to sequentially generate a sampling signal SAM, and sequentially supplies the sampling signal SAM to the latch 320.

The latch 320 sequentially samples the video data Data supplied from the timing controller 500 according to the sampling signal SAM from the shift register 310. Then, the latch 320 stores the sampled data on a single-line basis. At the same time, the latch 320 outputs the sampled video data RData corresponding to a single line to the digital-analog converter 330 in response to a source output enable signal SOE in the data control signal DVS.

In order to convert the sampled video data RData to an analog data voltage AData, the digital-analog converter 330 subdivides the reference gamma voltage GMA_V from the reference gamma voltage generator 600 into gray level-based gamma voltages. Then, the DAC 330 selects and outputs the subdivided gray level-based gamma voltage based on a gray level of the sampled video data RData for each of the sub-pixels. In this way, the DAC 330 converts the video data RData of each sub pixel into an analog data voltage AData.

When the DAC 330 selects and outputs the subdivided gray level-based gamma voltage based on the gray level of the video data RData of each sub-pixel, a dual type structure of the DAC 330 allows the subdivided gray level-based gamma voltages to be divided into a gamma voltage range corresponding to a high gray level and a gamma voltage range corresponding to a low gray level. Then, dual amplifiers (not shown) in the DAC 330 respectively amplify the gamma voltage corresponding to the high gray level and the gamma voltage corresponding to the low gray level into the data voltages AData and outputs each of the data voltages AData to each data line connection channel. At the same time, the DAC 330 transmits the video data AData corresponding to the single line as output to each data line connection channel to the output buffer 340.

In order to prevent the analog data voltage AData from the digital-analog converter 330 from being distorted according to a RC time constants of the data lines DL1 to DLm, the output buffer 340 may amplify the analog data voltages AData and supply the amplified video signals Vout to the respective data lines DL1 to DLm.

The DAC controller 350 controls the digital-analog converter 330 such that the digital-analog converter 330 divides the data voltage AData of each sub-pixel into a voltage corresponding to a high gray level and a voltage corresponding to a low gray level, and outputs the voltage corresponding to a high gray level and the voltage corresponding to a low gray level to each channel connected to the data line. In this connection, after, in a single horizontal line period, the analog data voltage AData corresponding to the high gray level or low gray level is output to each channel, the DAC controller 350 controls the digital-analog converter 330 to selectively output a middle gray level voltage in a blank period. Then, the DAC controller 350 controls the analog-to-digital converter 330 to output an analog data voltage AData corresponding to the high gray level or low gray level to each channel in a subsequent single horizontal line period.

Specifically, the DAC controller 350 generates an output control signal SC and supplies the SC to the digital-analog converter 330 such that the digital-analog converter 330 selectively outputs the data voltage corresponding to the high gray level or the low gray level to each channel in a single horizontal line period. Then, the DAC controller 350 supplies a first or second switching signal SC1 or SC2 to the digital-analog converter 330 such that the digital-to-analog converter 330 outputs the data voltage corresponding to the middle gray level having a preset level in the blank period after the single horizontal line period in which the data voltage corresponding to the high gray level or the low gray level is output. Then, the DAC controller 350 again supplies an output control signal SC to the digital-to-analog converter 330 such that, in a subsequent single horizontal line period after the blank period, the digital-analog converter 330 again outputs an analog data voltage corresponding to the high gray level or the low gray level to each channel.

FIG. 3 is a configuration diagram specifically illustrating a dual type digital-analog converter shown in FIG. 2 according to an embodiment of the present disclosure. FIG. 4 is a graph showing characteristics of low gray level-based and high gray level-based data voltages generated and output by the dual type DAC of FIG. 3 according to an embodiment of the present disclosure.

Referring to FIG. 3 and FIG. 4, the dual type digital-analog converter 330 includes a divided-voltage output module 330*a* and a dual type amplification module 330*b*.

The divided-voltage output module 330*a* and the dual type amplification module 330*b* of the digital-analog converter 330 are constituted in a corresponding manner to each channel connected to the data line.

The divided-voltage output module 330*a* subdivides the reference gamma voltage GMA_V into respective gray level-based gamma voltages, and selects and outputs a subdivided gray level-based gamma voltage according to a gray level of the video data RData corresponding to each sub-pixel. As shown in FIG. 4, GMA_RWGB1 . . . GMA_RWGB9; GMA_C10 is the gamma voltage for each gradation set in steps, and G0 to G1023 are gray scale values.

Specifically, the divided-voltage output module 330*a* includes a string of a plurality of resistors R to subdivide the reference gamma voltage GMA_V into the gray level-based gamma voltages, and a plurality of switches b1, b2, b3 for selecting and outputting a divided voltage corresponding to each resistor R based on bit data of the video data RData corresponding to each sub-pixel.

Each of the switches b1, b2, b3 is turned on according to tbit data of the video data RData to define each current path between each resistor corresponding to each divided voltage and the dual type amplification module 330*b*. In one example, in order to represent 255 gray levels corresponding to 8 bits data, a string of about 256 resistors as connected in series is required. Further, the number of the plurality of switches b1, b2, b3 must be about 510 in order to receive 8-bit data and select current paths based on the 8-bit data.

The divided-voltage output module 330*a* defines a low gray level current path such that gamma voltages corresponding to #0 to #127 gray levels among 255 gray levels corresponding to 8 bits are output to the low gray level current path. A gamma voltage lower than a middle voltage of the reference gamma voltage among the gray level-based gamma voltages may be output along the low gray level current path. Further, the divided-voltage output module 330*a* defines a high gray level current path such that gamma voltages corresponding to #128 to #255 gray levels of the 255 gray levels corresponding to 8 bits are output to the high gray level current path. A gamma voltage higher than a middle voltage of the reference gamma voltage among the gray level-based gamma voltages may be output along the high gray level current path.

The dual type amplification module 330*b* amplifies the low gray level-based gamma voltage or high gray level-based gamma voltage output from the divided-voltage output module 330*a* using different amplifiers and outputs the amplified gray level-based gamma voltage to each channel. For this purpose, the dual type amplification module 330*b* includes a first amplifier OP1, a first switching element SW1, a second amplifier OP2, a second switching element SW2, and an output switching element SW3.

Specifically, the first amplifier OP1 of the dual type amplification module 330*b* generates a first data voltage by amplifying one of the high gray level gamma voltages inputted through the high gray level current path of the divided-voltage output module 330*a*, and outputs the first data voltage to the output switching element SW3.

When the first switching element SW1 is turned on under control of the DAC controller 350, the first switching element SW1 allows transmitting a preset middle voltage Vref to the high gray level current path.

Further, the second amplifier OP2 of the dual type amplification module 330*b* generates a second data voltage by amplifying one of the low gray level gamma voltages inputted through the low gray level current path of the divided-voltage output module 330*a*, and outputs the second data voltage to the output switching element SW3.

When the second switching element SW2 is turned on under control of the DAC controller 350, the second switching element SW2 allows transmitting a preset middle voltage Vref to the low gray level current path.

The output switching element SW3 transmits the data voltage output from the first amplifier OP1 or the second amplifier OP2 and the middle voltage Vref to each channel under the control of the DAC controller 350.

To this end, the DAC controller 350 feeds the output control signal SC to the output switching element SW3 such that the output switching element SW3 selects the high gray level data voltage output through the first amplifier OP1 or the low gray level data voltage output through the second amplifier OP2 for a single horizontal line period and transmits the selected voltage to a corresponding channel.

In response to the output control signal SC, the output switching element SW3 then selects the high gray level data voltage output through the first amplifier OP1 or the low gray level data voltage output through the second amplifier OP2 for a single horizontal line period and transmits the selected voltage to the corresponding channel.

The DAC controller 350 transmits the first or second switching signals SC1 and SC2 to the first or second switching elements SW1 and SW2, respectively such that, after the single horizontal line period in which the data voltage corresponding to the high gray level or the low gray level is transmitted to the corresponding channel through the output switching element SW3, the middle voltage Vref of the preset level is output to the corresponding channel in the blank period. During the blank period, the output control signal SC remains unchanged.

When the first switching signal SC1 is transmitted to the first switching element SW1 in the blank period, the first switching element SW1 is turned on to transmit the middle voltage Vref to the high gray level current path. Then, the middle voltage Vref is output to the channel through the output switching element SW3.

When the second switching signal SC2 is transmitted to the second switching element SW2 in the blank period, the second switching element SW2 is turned on to transmit the middle voltage Vref to the low gray level current path. Then, the middle voltage Vref is output to the channel through the output switching element SW3.

The DAC controller 350 supplies the output control signal SC to the output switching element SW3 in a next single horizontal line period after the blank period to select the high gray level data voltage output through the first amplifier OP1 or the low gray level data voltage output through the second amplifier OP2 during a single horizontal line period and transmit the selected voltage to the corresponding channel.

Thus, every horizontal line period, the output switching element SW3 selects the high gray level data voltage of the first amplifier OP1 or the low gray level data voltage of the second amplifier OP2 for a single horizontal line period in response to the output control signal SC, and then transmits the selected data voltage to the corresponding channel. Then, the middle voltage Vref may be output to the corresponding channel every blank period as a period between neighboring horizontal line periods.

FIG. 5 shows configuration and waveform diagrams sequentially illustrating the method of driving the dual type amplification module shown in FIG. 3 according to an embodiment of the present disclosure.

Specifically, FIG. 5 shows the driving method in which, in a single horizontal line period, the dual type amplification module 330*b* outputs a data voltage corresponding to a low gray level, then outputs a middle voltage Vref in a blank period, and, then, in a next single horizontal line period, outputs a data voltage corresponding to a high gray level to the channel.

First, the DAC controller 350 reads a control packet CP of the digital video data transmitted from the timing controller 500 to the latch 320 for controlling of the dual type amplification module 330*b*. Then, the DAC controller 350 generates the output control signal SC, the first and second switching signals SC1 and SC2 according to a switching control signal included in the read control packet CP, and transmits the generated output control signal SC, first and second switching signals SC1 and SC2 to the switching elements SW1 and SW2 and SW3 of the dual type amplification module 330*b*.

The control packet CP is transmitted in a disable period of the SOE signal as the blank period (for example, in a signal period of a high logic). Thus, the DAC controller 350 reads the control packet CP every blank period and generates the output control signal SC, first and second switching signals SC1 and SC2 based on the control packet. To this end, the timing controller 500 may configure the video data Data so that the control packet CP is included in a portion of the digital video data corresponding to the blank period.

Referring to FIG. 5, the DAC controller 350 reads the control packet CP and supplies the output control signal SC having a high logic to the output switching element SW3 such that, for a single horizontal line period (1st AData Out), the output switching element SW3 sends, to the channel, a low gray level data voltage (3V) output through the second amplifier OP2.

Thus, in response to the output control signal SC of the high logic, the output switching element SW3 selects the low gray level data voltage (3V) output through the second amplifier OP2 for the single horizontal line period and transmits the selected voltage to the corresponding channel (a).

The DAC controller 350 transmits the second switching signal SC2 together with the output control signal SC to the second switching element SW2 such that, in a blank period after the single horizontal line period in which the data voltage corresponding to the low gray level is transmitted to the channel through the output switching element SW3, a middle voltage Vref (8V) is output to the corresponding channel.

When the second switching signal SC2 is transmitted to the second switching element SW2 in the blank period, the second switching element SW2 is turned on and allows transmitting the middle voltage Vref (8V) to the low gray level current path. Thus, the middle voltage Vref is output to the channel (b) through the output switching element SW3.

After the blank period, the DAC controller 350 supplies an output control signal SC having a low logic to the output switching element SW3 such that, in a subsequent single horizontal line period (2nd AData Out), the output switching element SW3 transmits a high gray level data voltage (12V) output through the first amplifier OP1 for a single horizontal line period, to the channel (c).

FIG. 6 shows configuration and waveform diagrams sequentially illustrating the method of driving the dual type amplification module shown in FIG. 3 in accordance with another embodiment.

Specifically, FIG. 6 shows the driving method in which, in a single horizontal line period, the dual type amplification module 330*b* outputs a data voltage corresponding to a high gray level, then outputs a middle voltage Vref in a blank period, and, then, in a next single horizontal line period, outputs a data voltage corresponding to a low gray level to the channel.

Referring to FIG. 6, the DAC controller 350 reads the control packet CP and supplies the output control signal SC having a low logic to the output switching element SW3 such that, for a single horizontal line period (1st AData Out), the output switching element SW3 sends, to the channel, a high gray level data voltage (12V) output through the first amplifier OP1.

Thus, in response to the output control signal SC of the low logic, the output switching element SW3 selects the high gray level data voltage (12V) output through the first amplifier OP1 for the single horizontal line period and transmits the selected voltage to the corresponding channel (a).

The DAC controller 350 transmits the first switching signal SC1 together with the output control signal SC to the first switching element SW1 such that, in a blank period after the single horizontal line period in which the data voltage corresponding to the high gray level is transmitted to the channel through the output switching element SW3, a middle voltage Vref (8V) is output to the corresponding channel.

When the first switching signal SC1 is transmitted to the first switching element SW1 in the blank period, the first switching element SW1 is turned on and allows transmitting the middle voltage Vref (8V) to the high gray level current path. Thus, the middle voltage Vref is output to the channel (b) through the output switching element SW3.

After the blank period, the DAC controller 350 supplies an output control signal SC having a high logic to the output switching element SW3 such that, in a subsequent single horizontal line period (2nd AData Out), the output switching element SW3 transmits a low gray level data voltage (3V) output through the second amplifier OP2 for a single horizontal line period, to the channel (c).

Thus, in each horizontal line period, the output switching element SW3 responds to the output control signal SC to select the high gray level data voltage output via the first amplifier OP1, or the low gray level data voltage output via the second amplifier OP2 for the single horizontal line period and to output the selected data voltage to the corresponding channel. Further, in each blank period between adjacent horizontal line periods, the middle voltage Vref is output to the corresponding channel. This may improve a response speed of the data voltage as necessary while preventing the heat generation to a maximum extent.

FIG. 7 is a block diagram specifically illustrating an organic light-emitting diode-based display device equipped with a data driver according to a second embodiment of the present disclosure. FIG. 8 is a configuration diagram specifically illustrating a signal transmission structure of a timing controller, a gamma controller, a reference gamma voltage generator, and a data driver shown in FIG. 7 according to an embodiment of the present disclosure.

As shown in FIG. 7 and FIG. 8, the organic light-emitting diode-based display device according to the present disclosure further includes a gamma controller 700. The gamma controller 700 detects a difference voltage between a sub-pixel-based analog data voltage corresponding to a current single horizontal line and a sub-pixel-based analog data voltage corresponding to a subsequent single horizontal line. The gamma controller 700 outputs a middle voltage varying signal GMS to vary the middle voltage Vref based on the detected difference voltage. In this connection, the gamma controller 700 is illustrated as a separate component from the timing controller 500 for ease of description. However, the present disclosure is not limited thereto. The gamma controller 700 may be configured to be included in the timing controller 500.

Specifically, the gamma controller 700 receives video data Data from the timing controller 500. The gamma controller 700 sequentially compares the video data corresponding to the current single horizontal line and the video data corresponding to the subsequent single horizontal line. Then, the gamma controller 700 detects a difference voltage between the sub-pixel-based analog data voltage corresponding to the current single horizontal line and the sub-pixel-based analog data voltage corresponding to the subsequent single horizontal line. The gamma controller 700 then generates the middle voltage varying signal GMS to vary the level of the middle voltage Vref based on the detected difference voltage. The gamma controller 700 then feeds the GMS signal to the reference gamma voltage generator 600.

FIG. 9 is a schematic diagram of the gamma controller shown in FIG. 8 according to an embodiment of the present disclosure.

The gamma controller 700 shown in FIG. 9 includes a video data storage 710, a voltage difference acquisition unit 720, and a voltage controller 730.

The video data storage 710 receives the video data Data from the timing controller 500 and stores the data therein on at least one horizontal line basis and outputs the data to the voltage difference acquisition unit 720. The video data storage 710 has a memory structure and outputs the video data such that the data outputting is delayed by at least one horizontal line.

The voltage difference acquisition unit 720 receives the video data corresponding to the current single horizontal line as stored in the video data storage 710 and sequentially compares the video data corresponding to the current single horizontal line with the video data corresponding to the subsequent single horizontal line. The voltage difference acquisition unit 720 then detects the difference voltage between the sub-pixel-based analog data voltage corresponding to the current single horizontal line and the sub-pixel-based analog data voltage corresponding to the subsequent single horizontal line based on the comparison result. The voltage difference acquisition unit 720 then generates difference voltage data containing the difference voltage value for each sub-pixel and transmits the difference voltage data to the voltage controller 730.

The voltage controller 730 sets the middle voltage value for each sub-pixel such that the middle voltage Vref for each sub-pixel is changed to a median voltage value or median level of the difference voltage for each sub-pixel (that is, a median voltage value of the difference voltage value). Then, the voltage controller 730 generates a middle voltage varying signal GMS(Vref) including the set middle voltage value and transmits the GMS to the reference gamma voltage generator 600.

The reference gamma voltage generator 600 varies the middle voltage Vref on a horizontal line period basis based on the middle voltage varying signal GMS supplied from the gamma controller 700 on a horizontal line period basis. Then, the varied middle voltage is transmitted to the digital-analog converter 330.

As described above, the digital-analog converter 330 according to the present disclosure includes the divided-voltage output module 330*a* and the dual type amplification module 330*b*. The digital-analog converter 330 amplifies the gamma voltages corresponding to the low gray level and the high gray level using the dual amplifiers of the dual type amplification module 330*b* respectively. The amplified gamma voltages are output to each channel. In this connection, the dual type amplification module 330*b* outputs a gamma voltage corresponding to a low gray level or a high gray level to each of the channels Ch1 to Chn. The dual type amplification module 330*b* supplies the middle voltage Vref having a variable voltage level to each of the channels Ch1 to Chn for every blank period between adjacent horizontal line periods. Based on the difference voltage between the sub-pixel-based analog data voltage corresponding to the current single horizontal line and the sub-pixel-based analog data voltage corresponding to the subsequent single horizontal line at every blank period, the level of the middle voltage Vref is varied. Then, the varied middle voltage is output to each channel.

FIG. 10 is configuration and waveform diagrams for sequentially illustrating the driving method of the dual type amplification module according to a second embodiment of the present disclosure.

Specifically, FIG. 10 shows the driving method of the dual type amplification module in which for a single horizontal line period, the dual type amplification module 330*b* outputs a data voltage corresponding to a low gray level, and, then, outputs a middle voltage Vref whose level is varied to a median voltage value of the difference voltage for each sub-pixel for a blank period, and, then, output a data voltage corresponding to a high gray level to the channel in a subsequent single horizontal line period.

Referring to FIG. 10, the DAC controller 350 reads the control packet CP and supplies the output control signal SC having a high logic to the output switching element SW3 such that, for a single horizontal line period (1st AData Out), the output switching element SW3 sends, to the channel, a low gray level data voltage (2V) output through the second amplifier OP2.

Thus, in response to the output control signal SC of the high logic, the output switching element SW3 selects the low gray level data voltage (2V) output through the second amplifier OP2 for the single horizontal line period and transmits the selected voltage to the corresponding channel (a).

The DAC controller 350 transmits the second switching signal SC2 together with the output control signal SC to the second switching element SW2 such that, in a blank period after the single horizontal line period in which the data voltage corresponding to the low gray level is transmitted to the channel through the output switching element SW3, a middle voltage Vref whose level is varied to a median voltage level (7V) of the difference voltage for each sub-pixel.

When the second switching signal SC2 is transmitted to the second switching element SW2 in the blank period, the second switching element SW2 is turned on and allows transmitting the middle voltage Vref (7V) to the low gray level current path. Thus, the middle voltage Vref is output to the channel (b) through the output switching element SW3.

After the blank period, the DAC controller 350 supplies an output control signal SC having a low logic to the output switching element SW3 such that, in a subsequent single horizontal line period (2nd AData Out), the output switching element SW3 transmits a high gray level data voltage (12V) output through the first amplifier OP1 for a single horizontal line period, to the channel (c).

FIG. 11 is a block diagram illustrating a gamma controller of an organic light-emitting diode (OLED) display device according to a third embodiment of the present disclosure.

The gamma controller 700 shown in FIG. 11 detects a difference voltage value between a sub-pixel-based data voltage corresponding to a current single horizontal line and a sub-pixel-based data voltage corresponding to a subsequent single horizontal line. When the detected difference voltage value is equal to or greater than a predetermined reference voltage value RRef, the gamma controller 700 outputs the middle voltage varying signal GMS so that the level of the middle voltage Vref is varied to the same voltage value as the sub-pixel data voltage corresponding to a following single horizontal line.

To this end, the gamma controller 700 may include a video data storage 710, a middle voltage setting unit 740, a data voltage analyzer 750, and a voltage controller 730.

The video data storage 710 receives the video data Data from the timing controller 500, stores the data on at least one horizontal line basis, and outputs the data to the data voltage analyzer 750.

The data voltage analyzer 750 receives the video data corresponding to the current single horizontal line stored in the video data storage 710 and sequentially compares the video data corresponding to the current single horizontal line with the video data corresponding to the subsequent single horizontal line. Then, the data voltage analyzer 750 detects a difference voltage between a sub-pixel-based analog data voltage corresponding to a current single horizontal line and a sub-pixel-based analog data voltage corresponding to a subsequent single horizontal line according to the comparison result. When the detected difference voltage value is equal to or higher than the reference voltage value RRef preset by the middle voltage setting unit 740, the data voltage analyzer 750 generates a voltage varying data CD so that the middle voltage Vref is varied to the same voltage value as a sub-pixel-based data voltage corresponding to the following single horizontal line and transmits the voltage varying data CD to the voltage controller 730.

The voltage controller 730 sets the middle voltage value for each sub-pixel such that the level of the middle voltage Vref level is varied to the same voltage value as the sub-pixel-based data voltage corresponding to the following single horizontal line based on voltage varying data the CD. Then, the voltage controller 730 generates a middle voltage varying signal GMS that includes the varied middle voltage value and transmits the GMS to the reference gamma voltage generator 600.

In response, the reference gamma voltage generator 600 varies or maintains the middle level of the voltage level on a horizontal line basis based on the middle voltage varying signal GMS supplied from the gamma controller 700 on a horizontal line basis. Then, the middle voltage Vref is transmitted to the digital-analog converter 330.

As described above, the digital-analog converter 330 according to the present disclosure includes the divided-voltage output module 330*a* and the dual type amplification module 330*b*. The dual type amplification module 330*b* according to the third embodiment outputs a high gray level data voltage output through the first amplifier OP1 or a low gray level data voltage output through a second amplifier OP2 for a single horizontal line period in response to reception of the output control signal SC from the DAC controller 350. The selected voltage is sent to the corresponding channel.

In the blank period, in response to the first or second switching signals SC1 and SC2, the middle voltage Vref from the reference gamma voltage generator 600 input via the first or second switching element SW1 or SW2 is output to the channel through the output switching element SW3. In this connection, the middle voltage Vref from the reference gamma voltage generator 600 has a voltage value level corresponding to the same level as the analog data voltage of the sub-pixel corresponding to the subsequent single horizontal line.

After the blank period, and in the subsequent single horizontal line period, the output switching element SW3 selects the high gray level data voltage output through the first amplifier OP1 or the low gray level data voltage output through the second amplifier OP2 in response to the output control signal SC. The selected voltage is sent to the corresponding channel.

FIG. 12 is configuration and waveform diagrams for sequentially illustrating the driving method of the dual type amplification module according to a third embodiment of the present disclosure.

Specifically, FIG. 12 shows the driving method of the dual type amplification module in which for a single horizontal line period, the dual type amplification module 330*b* outputs a data voltage corresponding to a low gray level, and, then, outputs a middle voltage Vref whose level is varied to the same voltage level as the data voltage of the sub-pixel corresponding to the subsequent single horizontal line for a blank period, and, then, output a data voltage corresponding to a high gray level to the channel in a subsequent single horizontal line period.

Referring to FIG. 12, the DAC controller 350 reads the control packet CP and supplies the output control signal SC having a high logic to the output switching element SW3 such that, for a single horizontal line period (1st AData Out), the output switching element SW3 sends, to the channel, a low gray level data voltage (2V) output through the second amplifier OP2.

Thus, in response to the output control signal SC of the high logic, the output switching element SW3 selects the low gray level data voltage (2V) output through the second amplifier OP2 for the single horizontal line period and transmits the selected voltage to the corresponding channel (a).

The DAC controller 350 transmits the second switching signal SC2 together the output control signal SC to the second switching element SW2 such that, in a blank period after the single horizontal line period in which the data voltage corresponding to the low gray level is transmitted to the channel through the output switching element SW3, a middle voltage Vref whose level is varied to the same voltage level (12V) as the data voltage of the sub-pixel corresponding to the subsequent single horizontal line.

When the second switching signal SC2 is transmitted to the second switching element SW2 in the blank period, the second switching element SW2 is turned on and allows transmitting the middle voltage Vref (12V) to the low gray level current path. Thus, the middle voltage Vref is output to the channel (b) through the output switching element SW3.

After the blank period, the DAC controller 350 supplies an output control signal SC having a low logic to the output switching element SW3 such that, in a subsequent single horizontal line period (2nd AData Out), the output switching element SW3 transmits a high gray level data voltage (12V) output through the first amplifier OP1 for a single horizontal line period, to the channel (c).

In the organic light-emitting diode-based display device and the method for driving the device according to the embodiments of the present disclosure having various technical features as described above, the data driver 300 divides the gray level-based gamma voltage for generating the data voltage into a high gray level range and a low gray level range. The high gray level and low gray level-based gamma voltages are output through the dual amplifiers or output stages, respectively to each of the data lines DL1 to DLm. Accordingly, this may stabilize the driving of the data driver 300 by reducing the amount of heat as generated while preventing an increase in power consumption.

Further, the data driver 300 in accordance with the present disclosure outputs the data voltage AData according to the gray level of the video data Data, and then outputs the gamma voltage Vref corresponding to the middle gray level to the data line for a blank period as a period before outputting the data voltage according to the gray level in the subsequent horizontal line period. Therefore, this may improve the displayed image quality by increasing the varying speed of the data voltage according to the brightness change of the displayed image.

Further, the data driver 300 in accordance with the present disclosure analyzes the data voltage magnitude of the currently displayed video data Data and the data voltage magnitude of the subsequently displayed video data Data. Then, the gamma voltage to be outputted to each of the data lines DL1 to DLm for the blank period may be varied according to the analysis result. Accordingly, this may further increase the varying speed of the data voltage in correspondence with the brightness change of the displayed image, and thus further improve the image quality of the displayed image.

The present disclosure as described above is not limited to the above-described embodiments and the accompanying drawings. It will be obvious to those skilled in the art that various substitutions, modifications and variations are possible without departing from the technical disclosure of the present disclosure. Therefore, the scope of the present disclosure is to be defined by the appended claims. It is intended that all changes and modifications that come within the meaning and range of equivalency of the claims and the equivalents thereof be included within the scope of the present disclosure.

What is claimed is:

1. An organic light-emitting diode-based display device comprising:

an organic light-emitting diode-based display panel having a plurality of pixel regions defined by a plurality of gates and data lines;

a data driver configured to:

divide a reference gamma voltage into a gamma voltage corresponding to a high gray level and a gamma voltage corresponding to a low gray level;

select one between the gamma voltage corresponding to the high gray level and the gamma voltage corresponding to the low gray level based on a gray level of video data; and supply the selected one as data voltage through a corresponding output stage among dual output stages to a corresponding data line of the display panel, wherein the dual output stages respectively correspond to the gamma voltage corresponding to the high gray level and the gamma voltage corresponding to the low gray level; and a digital-analog converter (DAC) controller configured to control the data driver such that the selected one is supplied through the corresponding output stage among the dual output stages to the corresponding data line, wherein the data driver includes a shift register for outputting a sampling signal, a latch for sequentially sampling sub-pixel-based video data and outputting sampled sub-pixel-based video data corresponding to a single horizontal line; and wherein the DAC controller is configured to:

subdivide the reference gamma voltage into respective gray level-based gamma voltages;

determine a gray level-based gamma voltage from the subdivided gray level-based gamma voltages based on the sampled sub-pixel-based video data;

select the one of the gamma voltage corresponding to the high gray level and the gamma voltage corresponding to the low gray level based on the determined gray level-based gamma voltage; and supplying the selected one to the corresponding output stage among the dual output stages.

2. The organic light-emitting diode-based display device of claim 1, wherein the DAC controller includes:

a divided-voltage output circuit configured to:

subdivide the reference gamma voltage into the respective gray level-based gamma voltages; and determine the gray level-based gamma voltage from the subdivided gray level-based gamma voltages based on the sampled sub-pixel-based video data;

select the one of the gamma voltage corresponding to the high gray level and the gamma voltage corresponding to the low gray level based on the determined gray level-based gamma voltage; and supply the selected one to the corresponding output stage among the dual output stages; and a dual type amplification module including the dual output stages, wherein the dual type amplification module includes dual amplifiers, wherein the dual type amplification module is configured to receive the selected one and to amplify the selected one using corresponding one between the dual amplifiers and to output the amplified one to a corresponding data line.

3. The organic light-emitting diode-based display device of claim 2, wherein the divided-voltage output circuit includes:

a series string of a plurality of resistors for subdividing the reference gamma voltage into the respective gray level-based gamma voltages;

a plurality of switches connected to the plurality of resistors, wherein the DAC controller controls the plurality of switches to select and output one of the sub-divided gamma voltages corresponding to the resistors based on a bit value of the sub-pixel-based video data;

a low gray level current path along which a gamma voltage lower than a middle voltage of the reference gamma voltage among the gray level-based gamma voltages is output; and a high gray level current path along which a gamma voltage higher than the middle voltage of the reference gamma voltage among the gray level-based gamma voltages is output.

4. The organic light-emitting diode-based display device of claim 3, wherein the dual type amplification module includes:

a first amplifier for amplifying a gamma voltage input through the high gray level current path and outputting the amplified voltage input through the high gray level current path as a first data voltage;

a first switching element for transmitting the middle voltage to the high gray level current path under control of the DAC controller;

a second amplifier for amplifying a gamma voltage input through the low gray level current path and outputting the amplified voltage input through the low gray level current path as a second data voltage;

a second switching element for transmitting the middle voltage to the low gray level current path under control of the DAC controller; and an output switching element for transmitting the middle voltage, and the first data voltage or the second data voltage to a corresponding data line under control of the DAC controller.

5. The organic light-emitting diode-based display device of claim 4, wherein the DAC controller generates a first output control signal and supplies the first output control signal to the output switching element such that, in a single horizontal line period, the output switching element selects either a high gray level data voltage output through the first amplifier or a low gray level data voltage output through the second amplifier and outputs the selected one to a corresponding data line, wherein the DAC controller generates and sends a first switching signal or a second switching signal to the first switching element or the second switching element such that, in a blank period after the single horizontal line period, the middle voltage corresponding to a preset level is output to the corresponding data line, wherein the DAC controller generates a second output control signal and supplies the second output control signal to the output switching element such that, in a subsequent single horizontal line period after the blank period, the output switching element selects either a high gray level data voltage output through the first amplifier or a low gray level data voltage output through the second amplifier and outputs the selected one to the corresponding data line.

6. The organic light-emitting diode-based display device of claim 4, wherein the device further comprises:

a gamma controller configured to:

determine a difference voltage between a sub-pixel-based data voltage corresponding to a current single horizontal line and a sub-pixel-based data voltage corresponding to a subsequent single horizontal line; and generate and output a middle voltage varying signal to vary a level of the middle voltage based on the detected difference voltage; and a reference gamma voltage generator configured to:

vary a level of the middle voltage on a horizontal line basis based on the middle voltage varying signal supplied from the gamma controller on a horizontal line basis; and transmit the varied middle voltage to the first switching element and the second switching element of the dual type amplification module.

7. The organic light-emitting diode-based display device of claim 6, wherein the gamma controller includes:

a video data storage for receiving and storing the video data on at least one horizontal line basis;

a voltage difference acquisition circuit configured to:

receive video data corresponding to the current single horizontal line stored in the video data storage, and sequentially comparing the video data corresponding to the current single horizontal line with video data corresponding to the subsequent single horizontal line;

determine the difference voltage between the sub-pixel-based analog data voltage corresponding to the current single horizontal line and the sub-pixel-based analog data voltage corresponding to the subsequent single horizontal line; and output difference voltage data including the difference voltage value for each sub-pixel; and a voltage controller configured to:

adjust, based on the difference voltage data, the middle voltage for each sub-pixel to a median level between the sub-pixel-based analog data voltage corresponding to the current single horizontal line and the sub-pixel-based analog data voltage corresponding to the subsequent single horizontal line; and generate a middle voltage varying signal containing the median level and transmitting the middle voltage varying signal to the reference gamma voltage generator.

8. The organic light-emitting diode-based display device of claim 7, wherein the DAC controller generates a first output control signal and supplies the first output control signal to the output switching element such that, in a single horizontal line period, the output switching element selects either a high gray level data voltage output through the first amplifier or a low gray level data voltage output through the second amplifier and outputs the selected one to a corresponding data line, wherein the DAC controller generates and sends a first switching signal or a second switching signal to the first switching element or the second switching element such that, in a blank period after the single horizontal line period, the middle voltage having the median level is output to the corresponding data line, wherein the DAC controller generates a second output control signal and supplies the second output control signal to the output switching element such that, in a subsequent single horizontal line period after the blank period, the output switching element selects either a high gray level data voltage output through the first amplifier or a low gray level data voltage output through the second amplifier and outputs the selected one to the corresponding data line.

9. The organic light-emitting diode-based display device of claim 4, wherein the device further comprises:

a gamma controller configured to:

determine a difference voltage between a sub-pixel-based data voltage corresponding to a current single horizontal line and a sub-pixel-based data voltage corresponding to a subsequent single horizontal line; and when the detected difference voltage value is greater than or equal to a preset reference voltage value, generate and output a middle voltage varying signal to vary a level of the middle voltage to the same voltage level as the sub-pixel data voltage corresponding to the subsequent single horizontal line; and a reference gamma voltage generator configured to:

vary or maintain the middle voltage level based on the middle voltage varying signal supplied from the gamma controller on a horizontal line basis; and transmit the varied or maintained middle voltage to the first switching element and the second switching element of the dual type amplification module.

10. A method for operating an organic light-emitting diode-based display device, the method comprising:

(a) sequentially supplying a gate-on signal to gate lines of an organic light-emitting diode-based display panel having a plurality of pixel regions defined therein;

(b) dividing a reference gamma voltage into a gamma voltage corresponding to a high gray level and a gamma voltage corresponding to a low gray level;

(c) selecting one between the gamma voltage corresponding to the high gray level and the gamma voltage corresponding to the low gray level based on a gray level of video data;

(d) supplying the selected one as data voltage through a corresponding output stage among dual output stages to a corresponding data line of the display panel, wherein the dual output stages respectively correspond to the gamma voltage corresponding to the high gray level and the gamma voltage corresponding to the low gray level; and (e) controlling a digital-analog converter such that the selected one is supplied through the corresponding output stage among the dual output stages to the corresponding data line, wherein (b) to (d) include:

outputting a sampling signal through a shift register;

sequentially sampling sub-pixel-based video data on a single horizontal line basis using the sampling signal;

subdividing, by the digital-analog converter, the reference gamma voltage into respective gray level-based gamma voltages;

determining, by the digital-analog converter, a gray level-based gamma voltage from the subdivided gray level-based gamma voltages based on the sampled sub-pixel-based video data;

selecting, by the digital-analog converter, the one of the gamma voltage corresponding to the high gray level and the gamma voltage corresponding to the low gray level based on the determined gray level-based gamma voltage; and supplying, by the digital-analog converter, the selected one to the corresponding output stage among the dual output stages.

11. The method of claim 10, wherein (e) includes:

controlling the digital-analog converter by a DAC controller such that the selected one is supplied through the corresponding output stage among the dual output stages to the corresponding data line; and controlling the digital-analog converter by the DAC controller such that, after supplying the selected one, a data voltage corresponding to a predetermined middle gray level is output to the corresponding data line.

12. The method of claim 11, wherein (b) to (d) include:

subdividing, by a divided-voltage output circuit of the digital-analog converter, the reference gamma voltage into the respective gray level-based gamma voltages;

determining, by the divided-voltage output circuit of the digital-analog converter, the gray level-based gamma voltage from the subdivided gray level-based gamma voltages based on the sampled sub-pixel-based video data;

selecting, by the divided-voltage output circuit of the digital-analog converter, the one of the gamma voltage corresponding to the high gray level and the gamma voltage corresponding to the low gray level based on the determined gray level-based gamma voltage and supplying the selected one;

amplifying and outputting the selected one by a dual type amplification module, wherein the dual type amplification module includes dual amplifiers, wherein the dual type amplification module amplifies the selected one using corresponding one between the dual amplifiers and outputs the amplified one to the corresponding data line.

13. The method of claim 12, wherein amplifying and outputting the selected one by the dual type amplification module includes:

amplifying the gamma voltage corresponding to the high gray level input through a high gray level current path using a first amplifier and outputting the amplified voltage input through the high gray level current path as a first data voltage through an output switching element;

transmitting a middle voltage through a first switching element to the high gray level current path under control of the DAC controller;

amplifying the gamma voltage corresponding to the low gray level input through a low gray level current path using a second amplifier and outputting the amplified voltage input through the low gray level current path as a second data voltage through the output switching element;

transmitting the middle voltage through a second switching element to the low gray level current path under control of the DAC controller; and transmitting the middle voltage, and the first data voltage or the second data voltage through the output switching element to the corresponding data line.

14. The method of claim 13, wherein amplifying and outputting the selected one by the dual type amplification module includes:

(i) determining, by a gamma controller, a difference voltage between a sub-pixel-based data voltage corresponding to a current single horizontal line and a sub-pixel-based data voltage corresponding to a subsequent single horizontal line;

(ii) generating and outputting, by the gamma controller, a middle voltage varying signal to vary a level of the middle voltage based on the detected difference voltage;

(iii) varying, by a reference gamma voltage generator, a level of the middle voltage level based on the middle voltage varying signal supplied from the gamma controller on a horizontal line basis; and (iv) transmitting, by the reference gamma voltage generator, the varied middle voltage to the first switching element and the second switching element of the dual type amplification module.

15. The method of claim 14, wherein (i) to (iv) include:

receiving and storing, by a video data storage, the video data on at least one horizontal line basis;

receiving, by a voltage difference acquisition circuit, video data corresponding to the current single horizontal line stored in the video data storage, and sequentially comparing the video data corresponding to the current single horizontal line with video data corresponding to the subsequent single horizontal line;

determining, by the voltage difference acquisition circuit, the difference voltage between the sub-pixel-based analog data voltage corresponding to the current single horizontal line and the sub-pixel-based analog data voltage corresponding to the subsequent single horizontal line;

outputting, by the voltage difference acquisition circuit, difference voltage data including the difference voltage value for each sub-pixel;

adjusting, based on the difference voltage data, the middle voltage for each sub-pixel to a median level between the sub-pixel-based analog data voltage corresponding to the current single horizontal line and the sub-pixel-based analog data voltage corresponding to the subsequent single horizontal line; and transmitting the adjusted middle voltage to the first and second switching elements of the dual type amplification module.

16. The method of claim 13, wherein amplifying and outputting the selected one by the dual type amplification module includes:

determining a difference voltage between a sub-pixel-based data voltage corresponding to a current single horizontal line and a sub-pixel-based data voltage corresponding to a subsequent single horizontal line;

when the detected difference voltage value is greater than or equal to a preset reference voltage value, generating and outputting a middle voltage varying signal to vary a level of the middle voltage to the same voltage level as the sub-pixel data voltage corresponding to the subsequent single horizontal line;

varying or maintaining a level of the middle voltage on a horizontal line basis based on the middle voltage varying signal supplied from the gamma controller on a horizontal line basis; and transmitting the varied or maintained middle voltage to the first switching element and the second switching element of the dual type amplification module.

* * * * *